US008221558B2

(12) United States Patent
Heisele et al.

(10) Patent No.: US 8,221,558 B2
(45) Date of Patent: Jul. 17, 2012

(54) DISHWASHER WITH SPRAY APPARATUS

(75) Inventors: Bernd Heisele, Sontheim (DE); Anton Oblinger, Wertingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 547 days.

(21) Appl. No.: 12/223,346

(22) PCT Filed: Jan. 11, 2007

(86) PCT No.: PCT/EP2007/050241

§ 371 (c)(1),
(2), (4) Date: Jul. 29, 2008

(87) PCT Pub. No.: WO2007/093469

PCT Pub. Date: Aug. 23, 2007

(65) Prior Publication Data

US 2009/0032066 A1 Feb. 5, 2009

(30) Foreign Application Priority Data

Feb. 16, 2006 (DE) ..... 10 2006 007 327

(51) Int. Cl.
*A47L 15/23* (2006.01)
*B29C 45/14* (2006.01)

(52) U.S. Cl. ..... 134/56 D; 134/57 D; 134/58 D; 264/249

(58) Field of Classification Search ..... 134/56 D, 134/57 D, 58 D; 264/248, 249, 250, 251
See application file for complete search history.

(56) References Cited

U.S. PATENT DOCUMENTS

| | | | | |
|---|---|---|---|---|
| 773,945 | A * | 11/1904 | Kronauer | 138/158 |
| 2,943,633 | A * | 7/1960 | Marmo et al. | 134/174 |
| 4,909,547 | A * | 3/1990 | Guy | 285/148.28 |
| 5,267,582 | A * | 12/1993 | Purtilo | 134/180 |
| 5,374,118 | A * | 12/1994 | Kruck et al. | 312/407 |
| 5,560,381 | A * | 10/1996 | Edwards | 134/176 |
| 5,662,744 | A * | 9/1997 | Tuller et al. | 134/25.2 |
| 6,325,083 | B1 | 12/2001 | Worter | |
| 6,964,090 | B2 * | 11/2005 | Mathieu et al. | 29/458 |
| 2003/0029478 | A1 * | 2/2003 | Hegeman | 134/10 |
| 2005/0081897 | A1 * | 4/2005 | Pardini | 134/58 D |
| 2005/0144773 | A1 | 7/2005 | Mathieu et al. | |
| 2006/0144830 | A1 | 7/2006 | Heisele et al. | |

FOREIGN PATENT DOCUMENTS

| | | |
|---|---|---|
| DE | 299 21 565 U | 5/2001 |
| DE | 202 20 465 U | 9/2003 |
| EP | 0 772 994 | 5/1997 |
| GB | 2 032 769 | 5/1980 |

OTHER PUBLICATIONS

International Search Report PCT/EP2007/050241.

* cited by examiner

*Primary Examiner* — Michael Barr
*Assistant Examiner* — Benjamin Osterhout
(74) *Attorney, Agent, or Firm* — James E. Howard; Andre Pallapies

(57) ABSTRACT

A dishwasher having a crockery basket for holding items to be washed and a spray apparatus including a first contoured body portion having a first edge, a second contoured body portion having a second edge which corresponds to the first edge wherein the first contoured body portion is joined to the second contoured body portion to form a fluid-tight hollow space therebetween and a joining seam member, with the first contoured body portion and the second contoured body portion being joined together using the joining seam member.

23 Claims, 3 Drawing Sheets

DISHWASHER WITH SPRAY APPARATUS

BACKGROUND OF THE INVENTION

The invention relates to a dishwasher, in particular a domestic dishwasher, with a crockery basket for holding items to be washed and a spray apparatus which has a first shaped component with a first edge and a second shaped component with a second edge which corresponds to the first edge, where the first and second shaped components are joined together by a joining seam at a seating face along their edges to form a fluid-tight hollow space. The invention relates in addition to a production method for a spray apparatus in a dishwasher, having the steps: preparing a first shaped component which has a first edge, preparing a second shaped component which has a second edge, and joining the first shaped component to the second shaped component by a joining seam at a seating face along the edges for the purpose of forming a fluid-tight hollow space.

Such a spray apparatus is known from DE 198 32 982 C2. The spray apparatus consists of two shaped components each of which is fixed onto a hub. The shaped components are manufactured from sheet metal or from plastic. For the purpose of mechanical jointing and to form a fluid-tight hollow space, an upper element is edge-formed around a lower element.

Another spray apparatus with a spray arm, constructed as a hollow body, which is mounted in the washing space of a dishwasher so that it can rotate, is known from DE 202 20 465 U1. The spray arm includes an upper part and a lower part. These two parts are manufactured from a thin metal sheet and are joined to each other by edge-forming.

A spray apparatus for a dishwasher, having an upper part made from a plastic and a lower part from a sheet bowl is known from DE-GM 78 31 102 U1. From FIG. 1 shown there, it follows that the joint between the upper and lower parts is effected by edge-forming.

As a jointing technique, edge-forming requires that at least one of the shaped components is manufactured from a metal. However, this makes the production of a spray apparatus of this generic type time consuming and cost-intensive, because of the numerous different production steps and differently constructed production machines.

DE 696 20 709 T2 discloses the fact that the profile of a spray apparatus for a dishwasher can be achieved by drawing the upper side of a spray element, if it is made of a metallic material. If the spray element is manufactured from a plastic material, the shape can be achieved by a press-molding operation.

It is also known how to manufacture spray apparatuses entirely from plastic by means of an extrusion blow-molding process. With this, a plastic which is available in granulated or powder form is plasticized in a heating process and the high-viscosity compound is then made into an appropriate shape by a forming tool. Because the spray apparatus is hollow in form, the initial body used for the manufacture of the spray arm is a tube manufactured in accordance with the extrusion process described, which is heated to a certain temperature and in this deformable state is pressed into a cooled profile tool by a blowing process. The blank thus manufactured has the shape of a fully-finished spray arm. Jet-like orifices are manufactured in a second production step. A method and device for manufacturing jet-like orifices in spray arms for dishwashers are known from DE 102 38 557 A1.

Furthermore, spray apparatuses are known in which the spray arm consists of a first and a second shaped component, which are joined together by a bonded joint made by butt welding with heat reflectors as a result of the forming of a joining seam. Prior to the butt welding, the shaped components are manufactured from a thermoplastic plastic, by an injection process in a tool. Disadvantages of spray apparatuses of this type are the high costs of manufacture and the danger that after the manufacturing operation ends tensions can build up which lead to twisting of the spray arm.

BRIEF SUMMARY OF THE INVENTION

The object of the present invention consists in specifying a generic spray apparatus for a dishwasher, a dishwasher with a spray apparatus of this type, and a manufacturing method for this spray apparatus, which permits cost-effective manufacture.

This object is achieved by a dishwasher in accordance with the invention with the features of claim 1 and with an inventive manufacturing method in accordance with claim 22. Advantageous embodiments follow from the dependent claims.

The dishwasher in accordance with the invention, in particular a domestic dishwasher, with a crockery basket for holding items to be washed and a spray apparatus which has a first shaped component with a first edge and a second shaped component with a second edge which corresponds to the first edge, where the first and second shaped components are joined together at a seating face along their edges to form a fluid-tight hollow space, where the joining seam consists of an additional material. This means that the joining seam does not originate from the material of the first and/or the second shaped component.

The joining seam, on the seating face of the first and the second shaped components, for the purpose of joining the first and second shaped components will preferably be embodied with at least one interface in each case between the joining seam and the first and second shaped components. In this region, the interfaces have the shape of the surface of the first and the second shaped components. Using an injection process, the joining seam is applied by tools to the two shaped components which are already present. At least in partial areas, this forms two interface regions (in cross-section) in each case, between the joining seam and the first and second shaped components. The interfaces or interface regions, as applicable, form between the joining seam and the first shaped component and between the joining seam and the second shaped component. These can be confirmed either with the naked eye or in material investigations, e.g. using a microscope. The interfaces or interface regions, in cross section two in each case, are produced on a joining seam because the joining seam is applied to the already existing first and second shaped components by an injection process. If the joining seam were, for example, produced by butt welding with heat reflectors, as with the prior art, the plastic of the first and second shaped components would be heated at the seating face and then this heated plastic would join together. Hence, with butt welding with heat reflectors no interface is formed, or only one. The term seating face refers to any region of the edges of the first and second shaped components which serves to join together the first and second shaped components.

The provision of a joining seam on the seating faces of the first and second shaped components enables the fluid-tight hollow space to be provided in a cost-effective way.

In accordance with one embodiment, the joining seam is manufactured from a plastic which can be processed by an injection process. In accordance with another embodiment, the joining seam is applied to the seating face using an injection process. As part of the manufacturing process, the joining seam can be manufactured in an injection machine with no additional process steps such as, for example, butt welding with heat reflectors or trimming, if the first and the second shaped components are made from a plastic. The spray apparatus can be manufactured fully automatically, with no cutting and no waste, and optionally in a single process step: the latter is a possibility if the first and the second shaped components are made from a plastic which is preferably thermoplastic, in particular are injection molded. In principle, the first and/or the second shaped component can be manufactured from a plastic, preferably a thermoplastic one, or metal. The use of plastic as the material has the advantage that the first and second shaped components can be produced by means of an injection process so that, for example, the internal contour of the shaped components can be freely defined. This can be advantageous in designing the hydraulic characteristics within the spray apparatus. Furthermore, it simplifies the integration of supplementary components, such as for example a venturi pipe, because the integration can be effected during the injection operation and no subsequent manual assembly is required.

In accordance with another embodiment, the first edge of the first shaped component and the second edge of the second shaped component each have a first edge section which extends away from the hollow space together with a second edge section which extends away from the first edge section and is essentially perpendicular thereto. Provision is made in addition that when the first and second edges are abutting the shape and arrangement of the first edge section and of the second edge section of the first and the second shaped components are, at least over some sections, symmetrical. This geometric embodiment of the first and second edges of the first and the second shaped components simplifies the application of the joining seam onto the spray apparatus.

In accordance with another embodiment, provision is made that the joining seam has a first end section and a second end section which project into a first gap, which is formed between the second edge section and the external shell of the first shaped component, and into a second gap, which is formed between the second edge section and the external shell of the second shaped component, and which clamp around each of the second edge sections. The joining seam has an essentially U-shaped form, in which the end sections of the two limbs of the "U" are turned in toward each other. Provision is made in addition that the outermost end of the first end section abuts the first edge section of the first shaped component and the outermost end of the second end section abuts the first edge section of the second shaped component. The interlocking of the joining seam and the edges of the first and second shaped components ensures the secure fixing of the joining seam onto the shaped components and a seal against the escape of liquid.

In accordance with another embodiment, the joining seam produces a mechanical joint between the first edge section of the first shaped component and the second edge section of the second shaped component. In accordance with another embodiment, the joining seam has, at least along sections, a bonded joint to the first shaped component and/or the second shaped component.

Another embodiment provides that the joining seam is formed around the seating face of the first and the second shaped components. By this means, a completely fluid-tight seal of the hollow space from the outside environment is guaranteed. In doing this, the joining seam will preferably be embodied in one piece, with no gaps.

In accordance with another variant, provision is made for the joining seam to be provided with at least one through-hole, so that the seating face is not fluid-tight at the site of the at least one through-hole. The spray apparatus has in addition an axis, on which the spray apparatus is mounted so that it is rotatable, whereby the at least one break is arranged on the spray apparatus close to its outer end in a radial direction. The at least one break is shaped and arranged in such a way that it has a tangential outlet for the washing liquor and serves as a drive jet. This eliminates the need to provide a separate drive jet with a tangential outlet in one of the two shaped components.

Provision is made in addition that the joining seam has a color which differs from the color or colors of the first and second shaped components. This produces the possibility of optically highlighting the joining seam, by which means the design can be accentuated.

In another embodiment, spray jets for washing liquor are formed on the first and/or the second shaped component. The spray jets apply washing liquor to the items to be washed.

Preferably, there is on the first or second shaped component a feeder pipe for washing liquor, in particular in the form of a venturi pipe embodied in one piece with the first or the second shaped component.

A manufacturing method in accordance with the invention, for a spray apparatus in a dishwasher, has the following steps: preparing a first shaped component which has a first edge, preparing a second shaped component which has a second edge, joining of the first shaped component to the second shaped component, for the purpose of forming a fluid-tight hollow space, at a seating face along the edges, whereby the joint is manufactured with a joining seam at the seating face by means of an injection process or an injection molding process, as appropriate. In the case of injection molding processes, shaped parts, e.g. the joining seam, are manufactured from molding compounds, e.g. a thermoplastic plastic, in molds, e.g. a tool or injection tool. The first and second shaped components are thus, at least in the region of the seating faces, surrounded by a tool or injection tool, into which is introduced a plastic which is preferably thermoplastic, for the purpose of manufacturing the joining seam.

The joining seam is manufactured from a plastic which is preferably thermoplastic. The material of the joining seam can be the same as the material of the first and the second shaped components, or another material which differs, for example, in its elastic modulus or color.

In a further embodiment, the first and/or the second shaped components are/is manufactured from a plastic which is preferably thermoplastic, using an injection process.

In a preferred embodiment, a feeder pipe for washing liquor, in particular in the form of a venturi pipe, is manufactured on the first or the second shaped component, during the manufacture using the injection process, in the manufacturing step for the first or the second shaped component. The shape of the injection tool thus includes the feeder pipe and the first or the second shaped component, i.e. the plastic which is preferably thermoplastic is introduced into this injection tool in a work step.

BRIEF DESCRIPTION OF THE DRAWINGS

The invention is explained in more detail below by reference to the figures. These show.

DETAILED DESCRIPTION OF THE PRESENT INVENTION

Figure 1:
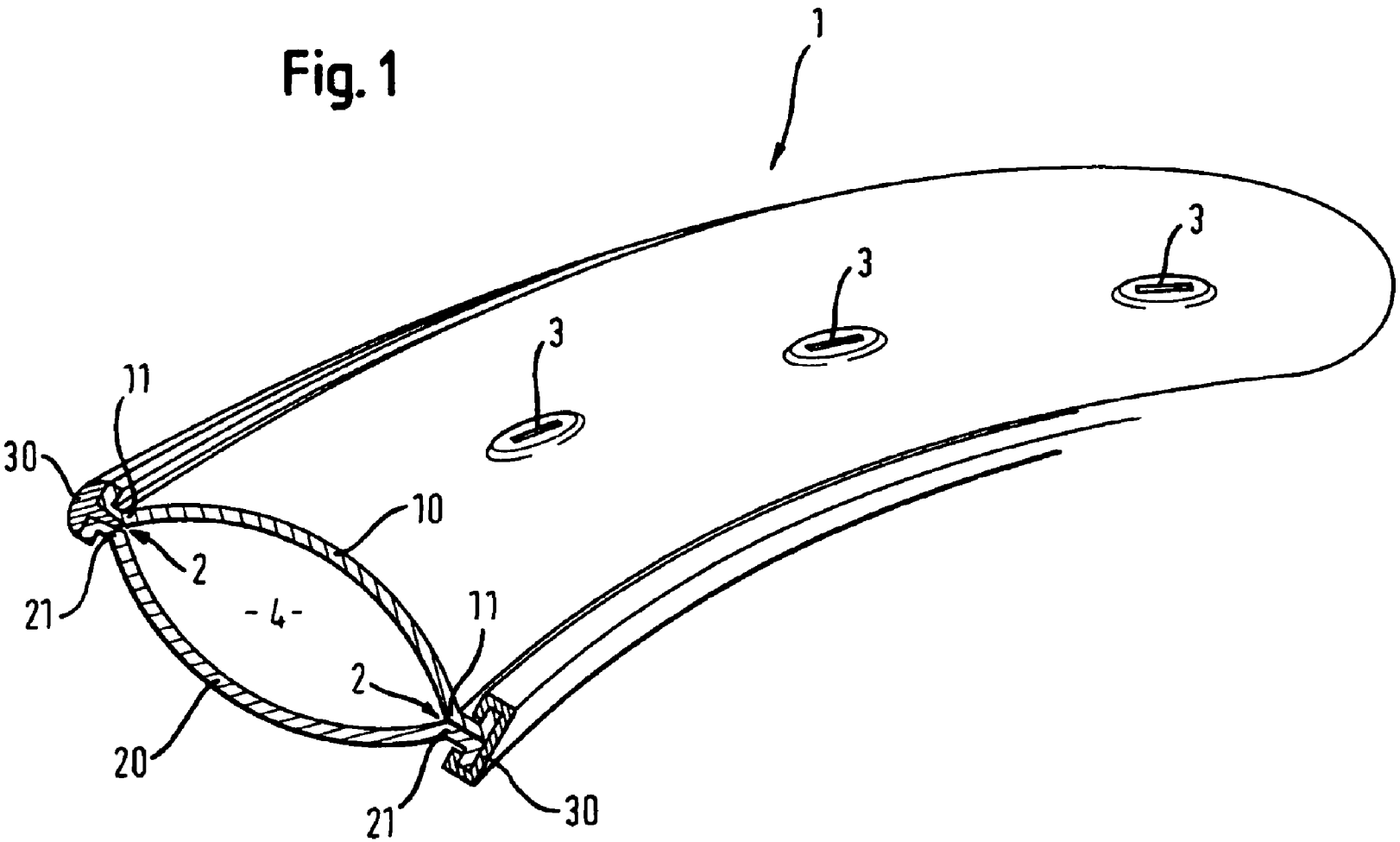
FIG. 1 a perspective drawing of a spray apparatus in accordance with the invention, FIG. 2 an enlarged section of a spray apparatus in accordance with the invention, with a joining seam member according to a first embodiment, and FIG. 3 an enlarged section of a spray apparatus in accordance with the invention, with a joining seam member according to a second embodiment.

FIG. 1 shows a perspective drawing of a section through a spray apparatus 1 in accordance with the invention. The spray apparatus 1, which will be referred to below as a spray arm 1, is mounted (not shown) in the familiar way in the dishwasher, on an axis of rotation so that it is able to rotate. The spray arm 1 is in the form of a hollow body, and includes a first shaped component 10 (also referred to as the upper part) and a second shaped component 20 (also referred to as the lower part). The first shaped component 10 has a typical arrangement of outlet holes 3 (also referred to as spray jets), by means of which washing liquor fed into the hollow space 4 can be sprayed under pressure onto the washing-up items which are to be cleaned.

The first shaped component 10 has a first perimeter edge 11. The second shaped component 10 has a second perimeter edge 21. The forms of the first and second edges 11, 21 in the illustration shown, in which the first shaped component 10 and the second shaped component 20 are arranged one above the other, correspond with each other. In the region of the abutting first and second edges 11, 21 a peripheral seating face 2 results which needs to be sealed off for the spray arm to function correctly.

The joining of the first shaped component 10 to the second shaped component 20 is effected by the provision of a joining seam 30 at the seating face 2 of the first and the second shaped components 10, 20. The joining seam 30 is made from a plastic, and is applied to the seating face 2 by an injection process. FIG. 1 here shows two different variants which are clarified below in more detail in FIGS. 2 and 3. In practice the joining seam 30 will be realized only by one variant. Because the joining seam 30 is produced using an injection process, where the shaped components 10, 20 are already available before the step for manufacturing the joining seam 30, interfaces 33 form between the joining seam 30 and the first shaped component 10 and between the joining seam 30 and the second shaped component 20.

It is preferable, but not obligatory, that the first shaped component 10 and the second shaped component 20 are made from a plastic. The use of an injection process permits, in particular, the arrangement and the shape of the outlet openings 30 and the internal contour of the first and/or second shaped components 10, 20 to be simply manufactured in a hydraulically desirable form. If both the first and the second shaped components 10, 20, and also the joining seam 30, are made from plastic, then it is possible to produce the spray arm in accordance with the invention fully automatically in one process step, with no cutting and no waste. The production can be effected in a single injection machine, with no necessity for additional process steps, such as for example butt welding with heat reflectors or machined cuts. Furthermore, additional assembly efforts are unnecessary. The construction of the first and second shaped components 10, 20 brings the further advantage that it simplifies the integration of additional components, such as a feeder tube (not shown) for washing liquor, e.g. in the form of a venturi pipe (the pressure in the constricted region of the feeder tube is atmospheric, so that if the rotating spray arm is mounted in this constricted region no expensive sealing measures are necessary), because they can be allowed for or formed, as applicable, as part of the injection process. Normally, a feeder tube is required on the upper shaped component of the upper spray arm, and on the lower shaped component of the lower spray arm. By this means too, additional assembly steps which have hitherto been required are unnecessary. Over and above this, injection technology with a tool-based seating contour is highly accurate.

Figure 2:
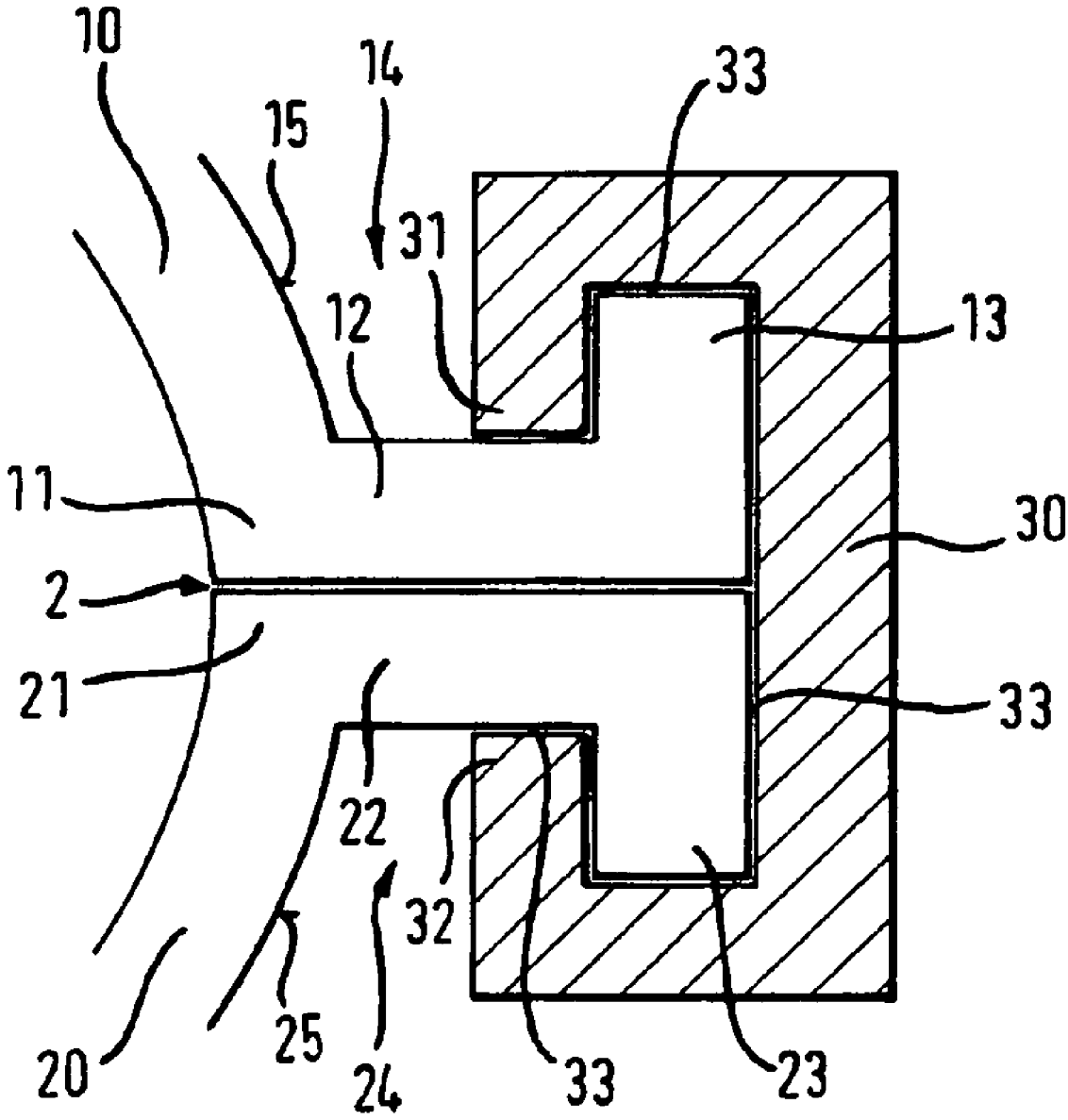
Figure 3:
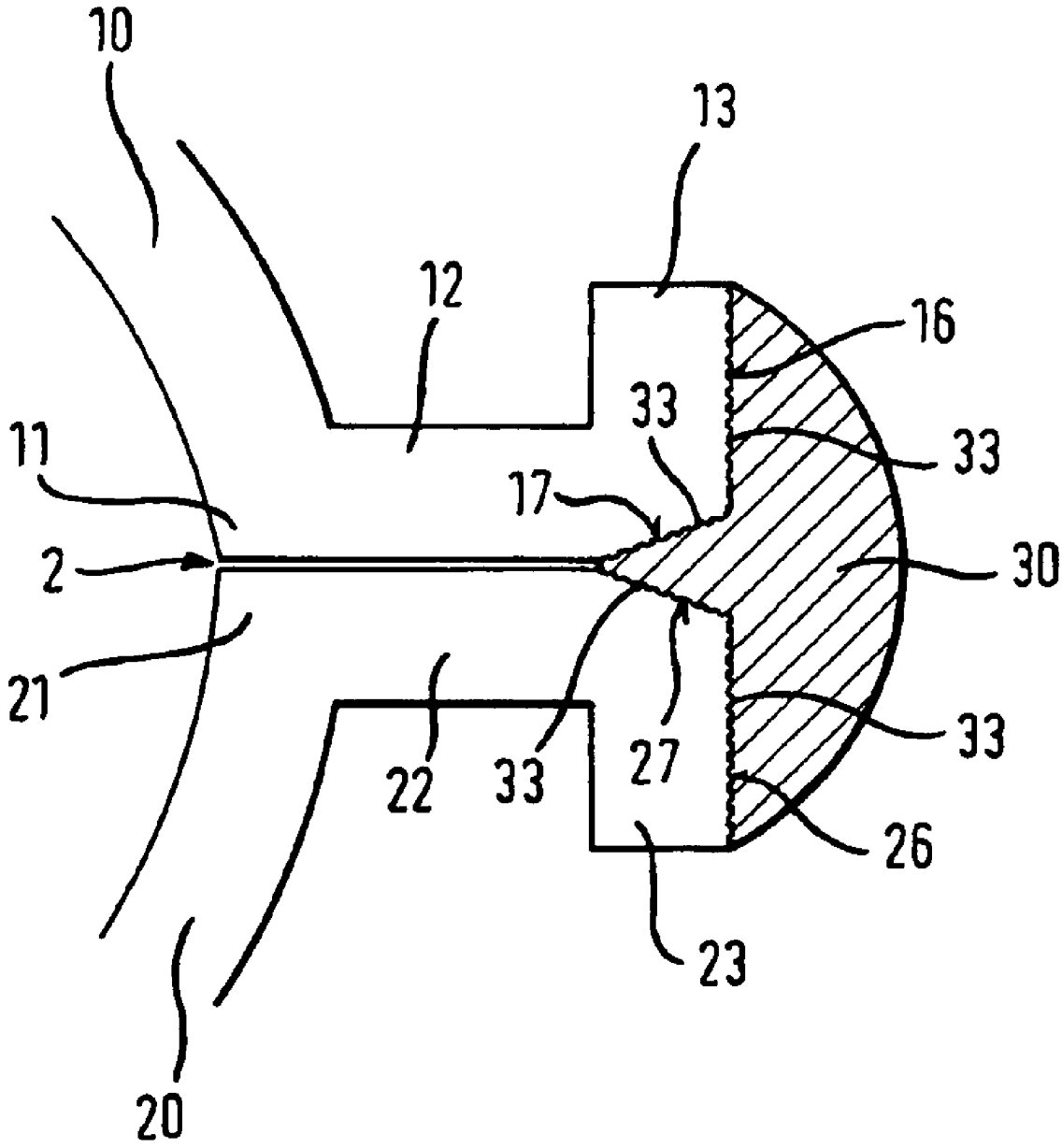

As is better seen from FIGS. 2 and 3, the edge 11 of the first shaped component 10 has a first edge section 12 which extends away from the hollow space 4. Arranged on the first edge section 12 is a second edge section 13 which extends away from the first edge section and essentially perpendicular thereto. Here, the second edge section 13 is arranged on the end of the first edge section 12 which is away from the first shaped component 10. In a corresponding way, the second edge 21 of the second shaped component 20 is embodied with a first edge section 22 and a second edge section 23.

If the first edge 11 and the second edge 21 are arranged in correspondence with each other, the result is a symmetric arrangement of the edge sections, 12, 13 and 22, 23 on the first and second edges respectively, 11, 21.

The joining seam 30 in accordance with a first embodiment, as shown in FIG. 2, has an essentially U-shaped form, so that the joining seam 30 clamps around the second edge sections 13, 23. Here, a first end section 31 of the U-shaped joining seam 30 abuts onto the first edge section 12 of the first shaped component 10. In a corresponding way, a second end section 32 of the U-shaped joining seam 30 abuts onto the first edge section 22 of the second shaped component 20. The shaping of the first and second edges 11, 12 and the design of the joining seam 30, produce a mechanical joint between the first shaped component 10 and the second shaped component 20, together with the joining seam 30. The seating face 2, which in the figure is shown with an exaggerated size for clarity, is thereby sealed to be fluid-tight. This reliably prevents the washing liquid in the hollow space 4 from escaping toward the spray arm's surroundings. Unlike the illustration in the drawing, the first gap 14 formed between the second edge section 13 and an outer surface 15 of the first shaped component 10 can be dimensioned so that it corresponds essentially to the width of the first end section 31 of the joining seam 30. This applies correspondingly for the second gap 24, which is formed between the second edge section 23 and an outer surface 25 of the second shaped component.

Depending on the materials used for the shaped components 10, 20 and the joining seam 30 it is also possible to realize a bonded joint between these elements.

FIG. 3 shows another exemplary embodiment with a joining seam 30 which is joined by bonding to the edges 11, 21 of the shaped components 10, 20. More precisely, in the region of the second edge sections, 13 and 23 respectively, a bonded joint to the joining seam 30 is provided. This bonded joint is manufactured between the joining seam 30 and the peripheral surfaces 16 and 26 and the surfaces 17 and 27 respectively. The bonded joint on the surfaces 17 and 27 results from the application of the joining seam 30 during an injection process. In doing this, the seating face 2 is slightly forced open from its outer region, so that the material of the joining seam 30 can penetrate into the seating face 2. This variant too produces a reliable fluid-tight seal on the hollow space 4 in the spray arm 1.

Because it is a simple possibility to color plastics with different colors, the color of the joining seam 30 can be chosen to be different from the color of the first and second shaped components 10, 20. This makes it simple to add a styling element to a spray arm.

LIST OF REFERENCE MARKS

1 Spray apparatus
2 Seating face

3 Outlet opening (spray jet)
4 Hollow space
10 First shaped component
11 First edge
12 First edge section
13 Second edge section
14 First gap
15 Outer surface
16 Peripheral surface
17 Surface
20 Second shaped component
21 Second edge
22 First edge section
23 Second edge section
24 Second gap
25 Outer surface
26 Peripheral surface
27 Surface
30 Joining seam
31 First end section
32 Second end section
33 Interface

The invention claimed is:

1. A dishwasher having a crockery basket for holding items to be washed, the dishwasher comprising:

a spray apparatus including a first contoured body portion having a first edge, a second contoured body portion having a second edge which corresponds to the first edge wherein the first contoured body portion is joined to the second contoured body portion to form a fluid-tight hollow space therebetween and a seating face at the first edge and the second edge when the first contoured body portion is joined to the second contoured body portion; and a joining seam member, with the first contoured body portion and the second contoured body portion being joined together using the joining seam member disposed at the seating face, wherein the first edge of the first contoured body portion and the second edge of the second contoured body portion are each formed with a first edge section which extends away from the hollow space together with a second edge section which extends away from the first edge section and is essentially perpendicular thereto, and wherein the joining seam member is formed with a first end section and a second end section which project into a first gap formed between the second edge section and an outer surface of the first contoured body portion, and into a second gap formed between the second edge section and an outer surface of the second contoured body portion, and which clamp around respective second edge sections.

2. The dishwasher according to claim 1 wherein the joining seam member is formed from a plastic.

3. The dishwasher according to claim 1 wherein the joining seam member is applied to the seating face using an injection process.

4. The dishwasher according to claim 1 wherein when the first edge and second edge abut one another, and wherein the shape and arrangement of the first edge section on the first contoured body portion is symmetrical with the second edge section on the second contoured body portion, at least at predetermined locations along at least one of the first body portion and the second body portion.

5. The dishwasher according to claim 1 wherein the joining seam member is generally U-shaped in cross-section wherein the end portions of the "U" are directed inwardly toward each other.

6. The dishwasher according to claim 1 wherein the outermost end of the first end section abuts the first edge section of the first contoured body portion and the outermost end of the second end section abuts the first edge section of the second contoured body portion.

7. The dishwasher according to claim 1 wherein the joining seam member produces a mechanical joint between the first edge section of the first contoured body portion and the second edge section of the second contoured body portion.

8. The dishwasher according to claim 1 wherein the joining seam member includes a bonded joint to at least one of the first contoured body portion and the second contoured body portion.

9. The dishwasher according to claim 1 wherein the joining seam member extends around the seating face of the first contoured body portion and the second contoured body portion.

10. The dishwasher according to claim 9 wherein the joining seam member is formed continuously as a single piece.

11. The dishwasher according to claim 1 wherein the joining seam member is formed with at least one through-hole wherein the seating face is not fluid-tight at the site of the at least one through-hole.

12. The dishwasher according to claim 11 and further comprising an axis about which the spray apparatus can rotate, whereby the at least one through-hole is arranged on the spray apparatus close to an outer end thereof.

13. The dishwasher according to claim 11 wherein the at least one through-hole is formed with a tangential outlet for washing liquor and functions as a drive jet.

14. The dishwasher according to claim 1 wherein at least one of the first contoured body portion and the second contoured body portion is manufactured from at least one of a plastic and metal.

15. The dishwasher according to claim 1 wherein the joining seam member is formed with a color which differs from the color of the first and second contoured body portions.

16. The dishwasher according to claim 1 wherein at least a portion the spraying apparatus is formed as a spray arm.

17. The dishwasher according to claim 1 wherein the at least one of the first contoured body portion and the second contoured body portion is manufactured using an injection process.

18. The dishwasher according to claim 1 wherein at least one of the first contoured body portion and the second contoured body portion is formed with at least one spray jet for passing washing liquor therethrough.

19. The dishwasher according to claim 1 and further comprising a feeder pipe for supplying washing liquor embodied in one piece with at least one of the first contoured body portion and the second contoured body portion.

20. A manufacturing method for a spray apparatus in a dishwasher, comprising the following steps:

providing a first contoured body portion having a first edge, providing a second contoured body portion having a second edge, providing a joining seam member manufactured using an injection process; joining the first contoured body portion to the second contoured body portion for the purpose of forming a fluid-tight hollow space, at a seating face using the joining seam member along the respective first and second edges, wherein the first edge of the first contoured body portion and the second edge of the second contoured body portion are each formed with a first edge section which extends away from the hollow space together with a second edge section which extends away from the first edge section and is essentially perpendicular thereto, and wherein the joining seam member is formed with a first end section and a second end section which project into a first gap formed between the second edge section and an outer surface of the first contoured body portion, and into a second gap formed between the second edge section and an outer surface of the second contoured body portion, and which clamp around respective second edge sections.

21. The method according to claim 20 wherein the step of providing a joining seam member includes providing a joining seam member manufactured from a plastic.

22. The method according to claim 20 wherein the steps of providing the first and the second contoured body portions include providing at least one of a first body portion and a second body portion manufactured using an injection process from a plastic.

23. The method according to claim 22 wherein the steps of providing the first and the second contoured body portions include providing a feeder pipe for washing liquor disposed on at least one of the first contour body portion and the second contoured body portion, the feeder pipe manufactured using an injection process during at least one of the step of providing the first contoured body portion and the step of providing the second contoured body portion.

* * * * *